US011759930B2

(12) United States Patent
Jiang et al.

(10) Patent No.: US 11,759,930 B2
(45) Date of Patent: Sep. 19, 2023

(54) LOCKING DEVICE FOR ADJUSTING NAILING FORCE OF ELECTRIC NAIL GUN

(71) Applicant: Zhejiang Rongpen Air Tools Co., Ltd., Zhejiang (CN)

(72) Inventors: Zhonghua Jiang, Zhejiang (CN); Xiaorong Li, Zhejiang (CN); Fazheng Yang, Zhejiang (CN)

(73) Assignee: Zhejiang Rongpeng Air Tools Co., Ltd., Zhejiang (CN)

( * ) Notice: Subject to any disclaimer, the term of this patent is extended or adjusted under 35 U.S.C. 154(b) by 7 days.

(21) Appl. No.: 17/488,327

(22) Filed: Sep. 29, 2021

(65) Prior Publication Data

US 2023/0059101 A1 Feb. 23, 2023

(30) Foreign Application Priority Data

Aug. 23, 2021 (CN) ..... 202110965115.4

(51) Int. Cl.
*B25C 1/06* (2006.01)

(52) U.S. Cl.
CPC ..... *B25C 1/06* (2013.01)

(58) Field of Classification Search
CPC .. B25C 1/06; B25C 1/04; B25C 1/041; B25C 1/047; B25C 1/048; B25C 1/00
USPC ..... 227/8
See application file for complete search history.

(56) References Cited

U.S. PATENT DOCUMENTS

2020/0238494 A1* 7/2020 Li ..... B25C 1/047
2021/0354276 A1* 11/2021 Zhang ..... B25C 1/06
2022/0226977 A1* 7/2022 Nettleton ..... B25C 1/188

* cited by examiner

*Primary Examiner* — Anna K Kinsaul
*Assistant Examiner* — Luis G Del Valle

(57) ABSTRACT

A locking device for adjusting nailing force of an electric nail comprises a power box, a driving motor, and an upper cylinder and lower cylinder provided on the right side of the power box. The driving motor is connected with connecting arm through a reducing mechanism. The end of the connecting arm is provided with an eccentric spindle. A lower piston is provided inside the lower cylinder. The lower piston is hinged with a piston arm on its top side. The piston arm is connected to the eccentric spindle. An upper piston is provided inside the upper cylinder. A firing pin is provided at the center of the sidewall on the left side of the upper piston. The left end of the firing pin sticks out of the upper cylinder. A fixing part is provided on the left side of the upper cylinder and above the power box.

10 Claims, 9 Drawing Sheets

LOCKING DEVICE FOR ADJUSTING NAILING FORCE OF ELECTRIC NAIL GUN

BACKGROUND OF INVENTION

1. Field of the Invention

The present invention relates to a locking device for adjusting nailing force of an electric nail gun.

2. Description of Related Art

During the nailing operation of the electric nail gun, the firing pin shoots the nail in the nailing channel out of the electric nail gun from its nozzle. When the electric nail gun is not in use, the firing pin will be locked through the locking block of the locking device. When the electric nail gun is to be used again, the locking device must be released manually by the user, so that the firing pin can move freely. This kind of unlocking method is obviously inconvenient, and will significantly affect the nailing efficiency. Also, in the conventional locking device, the locking block is tightly pressed upon the bayonet opening of the firing pin through an elastic spring. This kind of locking method will cause a massive pressure applied by the locking block upon the bayonet opening of the firing pin. During the course of repeated locking and unlocking, there will be frequent collisions between the locking block and the bayonet opening, resulting in wearing of the surface and the accuracy of position of the firing pin when it is locked, and subsequently affecting the nailing quality.

During actual operations of the electric nail gun, when facing different positions or different objects, the requirement for the nailing force is often different. However, the nailing force is determined by the driving motor of the electric nail gun, which can only produce a fixed nailing force. The nailing force is not adjustable. If the nailing force needs to be changed, the whole driving motor must be replaced. This is certainly inconvenient and costly.

SUMMARY OF THE INVENTION

To solve the existing technical problem, the present invention provides a locking device that can adjust the nailing force of an electric nail gun. It not only has the effect of locking the firing pin, but also can effectively prevent the locking block from continuously colliding with the inner wall of the bayonet during the locking process. In the case of wear, the nailing force can be adjusted according to actual needs.

The technical solutions adopted by the present invention to solve the above technical problems are:

A locking device for adjusting nailing force of an electric nail gun, comprising a power box, a driving, motor configured inside the power box, and an upper cylinder and a lower cylinder provided on a right side of the power box, wherein the lower cylinder is located right beneath the upper cylinder, the driving motor is connected with a connecting arm through a reducing mechanism, an end of the connecting arm is provided with an eccentric spindle, a lower piston is provided inside the lower cylinder, a top side of the lower piston is hinged with a piston arm, the piston arm is connected to the eccentric spindle, an upper piston is provided inside the upper cylinder, a firing pin is provided at a center of the sidewall on a left side of the upper piston, the left end of the firing pin sticks out of the upper cylinder, a fixing part is provided on a left side of the upper cylinder and above the power box, one end of the fixing part is fixed on the upper cylinder through a first screw and a second screw; a rear side of the upper surface of the power box is provided with a rotating groove; a bottom of a rotating groove is provided with a rotating hole communicated to an inside space of the power box; a matching rotating bushing is provided inside the rotating hole, and a matching rotating shaft is provided inside the rotating bushing; a lower end of the rotating shaft sticks downward into the power box and is provided with a short rocker; a torsion spring is sleeved outside the rotating bushing; one end of the torsion spring is fixed on the short rocker, the other end of the torsion spring is fixed on the inner wall of the power box; an upper end of the rotating shaft is provided with an automatic unlocking device matching the rotating groove; a matching locking block is provided on a right side of the automatic unlocking device; the sidewall of the firing pin on the side facing the locking block is provided with a bayonet opening; a locking part matching the bayonet opening is provided on the locking block; the lower end of the second screw sticks into the inside space of the power box and is hinged with a long rocker; the long rocker is provided with a nailing force adjusting device matching the short rocker.

More particularly, wherein the automatic unlocking device includes a driving wheel configured on the upper end of the rotating shaft, said driving wheel is located inside the rotating groove; the upper surface of the power box is provided with a positioning slot communicated to the rotating groove, the positioning slot is located on the right side of the rotating groove; a matching locking seat is provided inside the positioning slot, the locking seat is fixed inside the positioning slot through a third screw; the upper surface of the locking seat is provided with a rotating lug boss; the locking block is sleeved outside the rotating lug boss through a movable hole configured in its center; a ball groove is provided on the left side of the lower surface of the locking block; the left part of the locking seat is provided with a lifting hole communicated to the ball groove; the edge on the front side the driving wheel is provided with an arc-shaped unlocking slot, the slot sidewall of the unlocking slot adjacent to the lifting hole is tilted toward the hole; the left side of the locking seat is located above the driving wheel and limits the driving wheel to jump upward; a locking steel ball is provided inside the lifting hole, the lower end of the locking steel ball is pressed against the upper surface of the driving wheel, the upper end of the locking steel ball is embedded into the ball groove; the sidewall of the fixing part on the left side is provided with a fixing arm; the fixing arm and the left part of the locking block are connected to each other through a draw spring.

More particularly, wherein the bottom of the rotating groove is provided with a limiting slot, located on one side of the top orifice of the rotating hole, the limiting slot is in an arc shape, the lower surface of the driving wheel is provided with a limiting column matching the limiting slot.

More particularly, wherein a limiting gasket is provided between the rotating lug boss and the head of the third screw, and the outer diameter of the limiting gasket is larger than the inner diameter of the locking block.

More particularly, wherein the nailing force adjusting device comprises a push plate configured on the tip of the long rocker, the position of the push plate corresponds to the position of the eccentric spindle, the push plate is located on the side of the long rocker away from the short rocker, the sidewall of the long rocker on the side facing the short rocker is provided with an adjusting plate, the adjusting plate is provided with an adjustment screw hole, the adjustment screw hole is in threaded connection with an adjusting bolt, the sidewall of the short rocker on the side facing the long rocker is provided with an unlocking plate, with its position corresponding to the position of the adjusting plate, one end of the adjusting bolt sticks out of the adjustment screw hole, and is pressed upon the unlocking plate.

More particularly, wherein the end of the adjusting bolt pressed upon the unlocking plate is hemispherical.

More particularly, wherein the end of the adjusting bolt not pressed upon the unlocking plate sticks out of the adjustment screw hole and is in threaded connection with a fastening nut pressed against the adjusting plate.

More particularly, wherein the upper surface of the power box is provided with a catching slot, with its position corresponding, to the second screw; a matching guiding plate is provided inside the catching slot, the firing pin is located above the guiding plate and is pressed against the upper surface of the guiding plate; the rear part of the guiding plate protrudes backward out of the catching slot and covers the unlocking slot from above.

More particularly, the inner wall of the bayonet opening on the left side is provided with an arc-shaped guiding surface; the left side of the locking part is provided with a slide-out surface matching the guiding surface.

More particularly, wherein the front side of the end of the fixing part fixed by the first screw is provided with a stopping block; the sidewall on the right side of the locking block is provided with a limiting position pressed against the stopping block.

In contrast to the prior art, the present invention of a locking device for adjusting nailing force of an electric nail gun uses the locking steel ball of an automatic unlocking device to limit the position of the locking block, instead of using an elastic spring to tightly press the locking part of the locking block upon the bayonet opening of the firing pin, to achieve the locking effect. This can effectively avoid surface wearing caused by repeated collision between the locking part of the locking block and the bayonet opening, and can therefore ensure accurate position of the firing pin when locked by the locking part of the locking block. Thus, the nailing quality is guaranteed. When the firing pin is moved, the locking part of the locking block will be automatically moved out of the bayonet opening under the drive of the firing pin, so that the locking state can be automatically released. Moreover, the nailing force adjusting device can effectively adjust the nailing force of the firing pin. With the capability to adjust the nailing force, the electric nail gun can meet different nailing requirements without the hassle to replace the whole driving motor, saving a lot of usage cost.

DETAILED DESCRIPTION OF THE INVENTION

Figure 1:
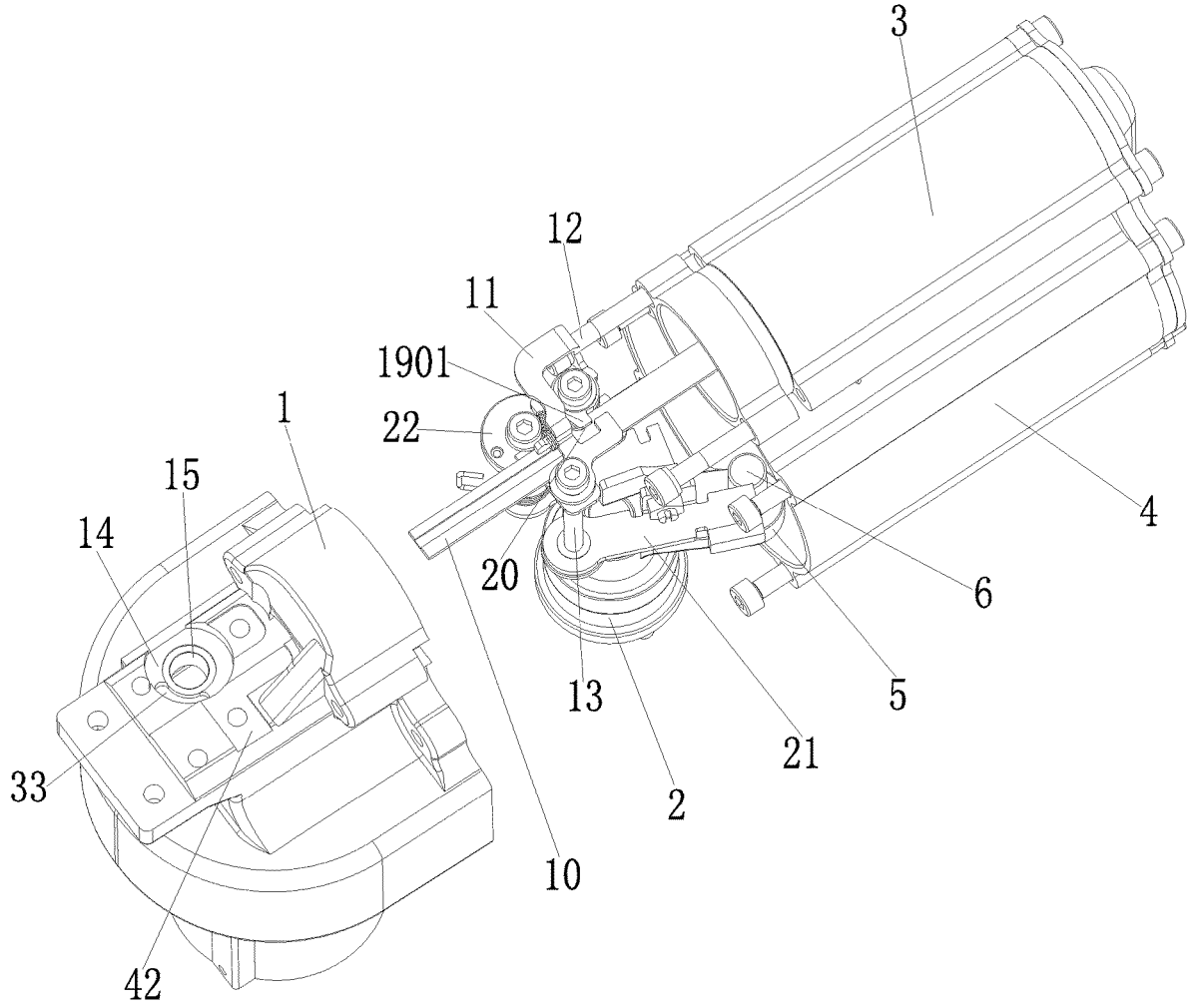
FIG. 1 is a structural view of the present invention of a locking device for adjusting nailing force of an electric nail gun.
Figure 2:
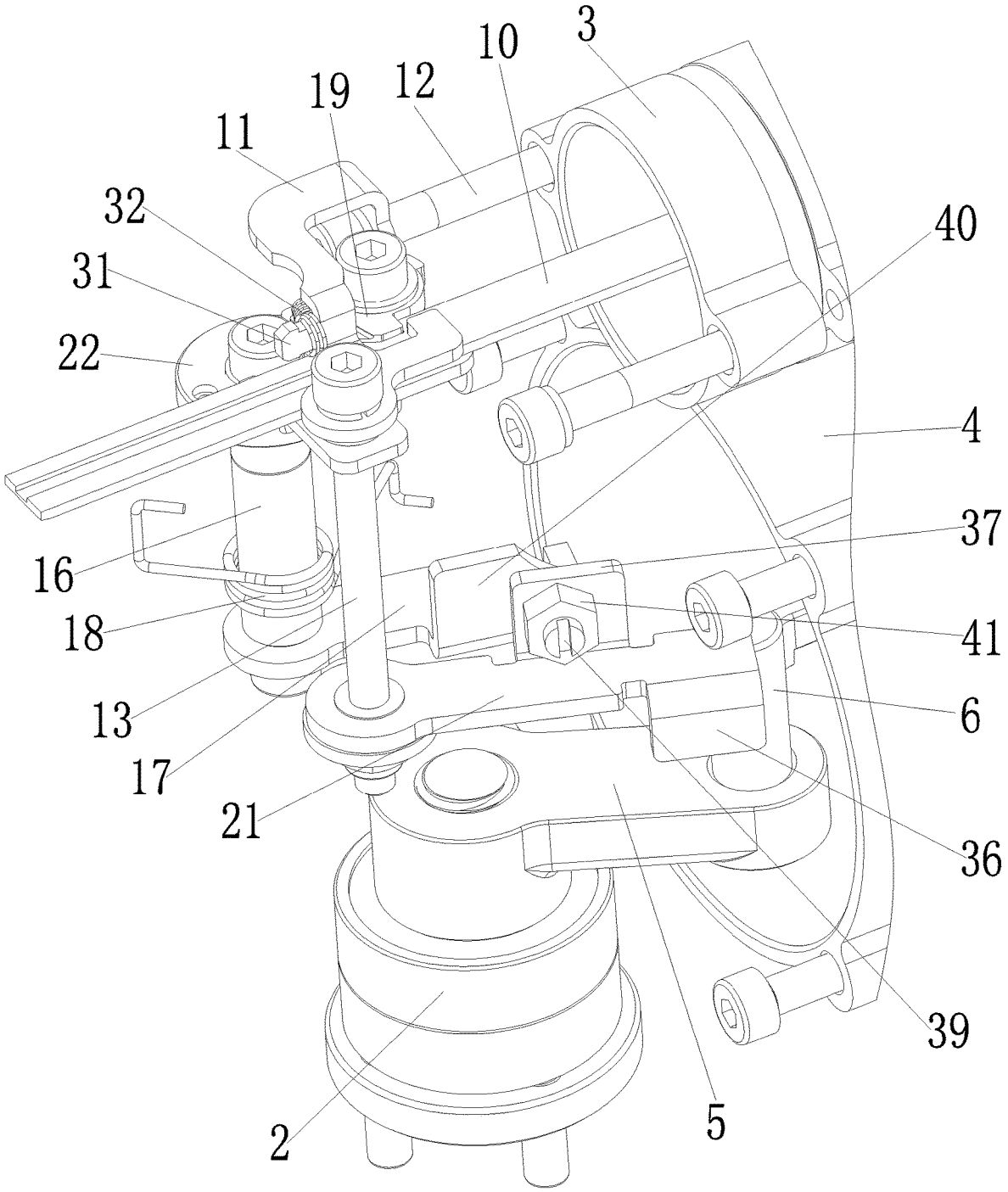
FIG. 2 is a partial structural view of the present invention.
Figure 3:
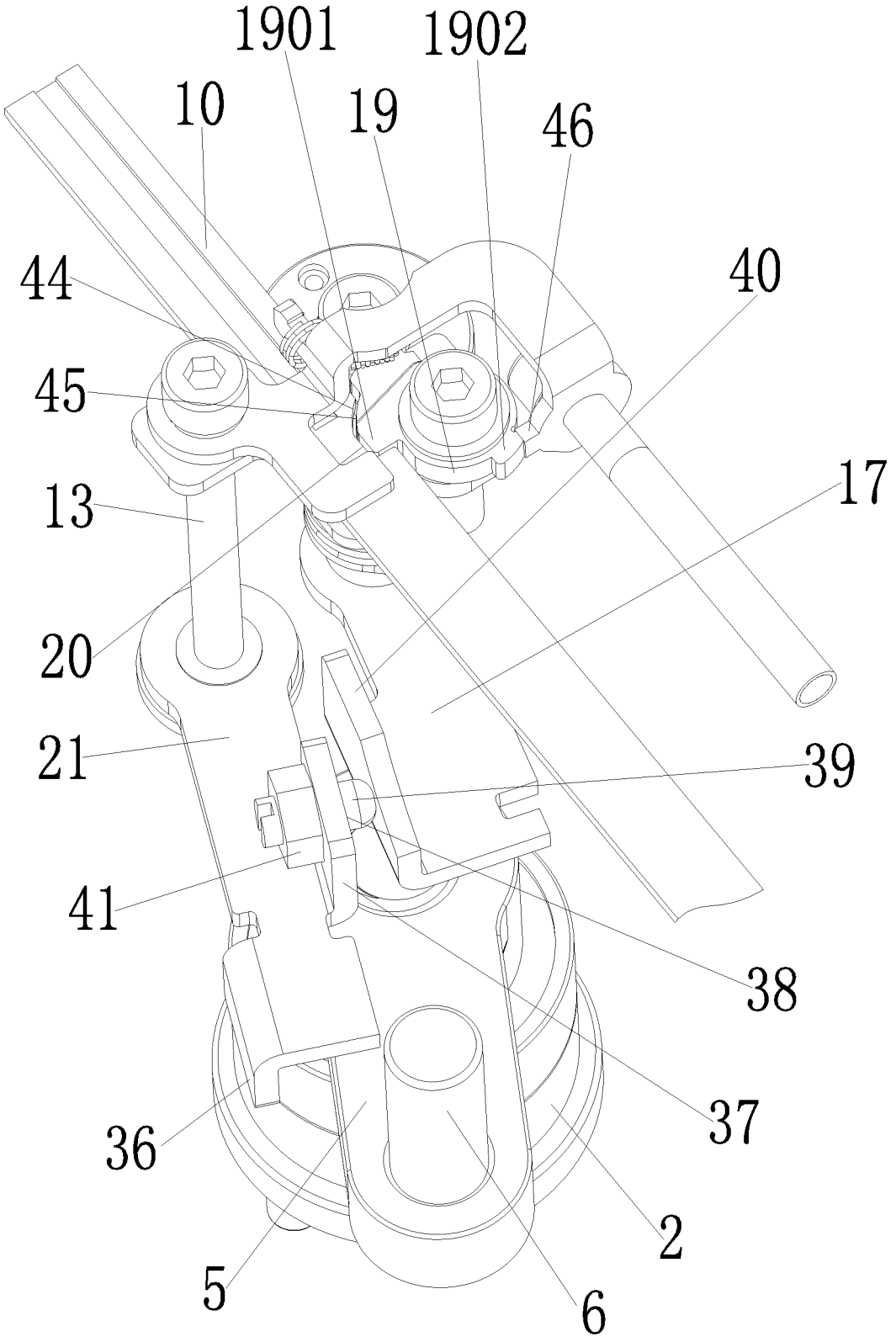
FIG. 3 is a structural view of the nailing force adjusting device from one viewing angle.
Figure 4:
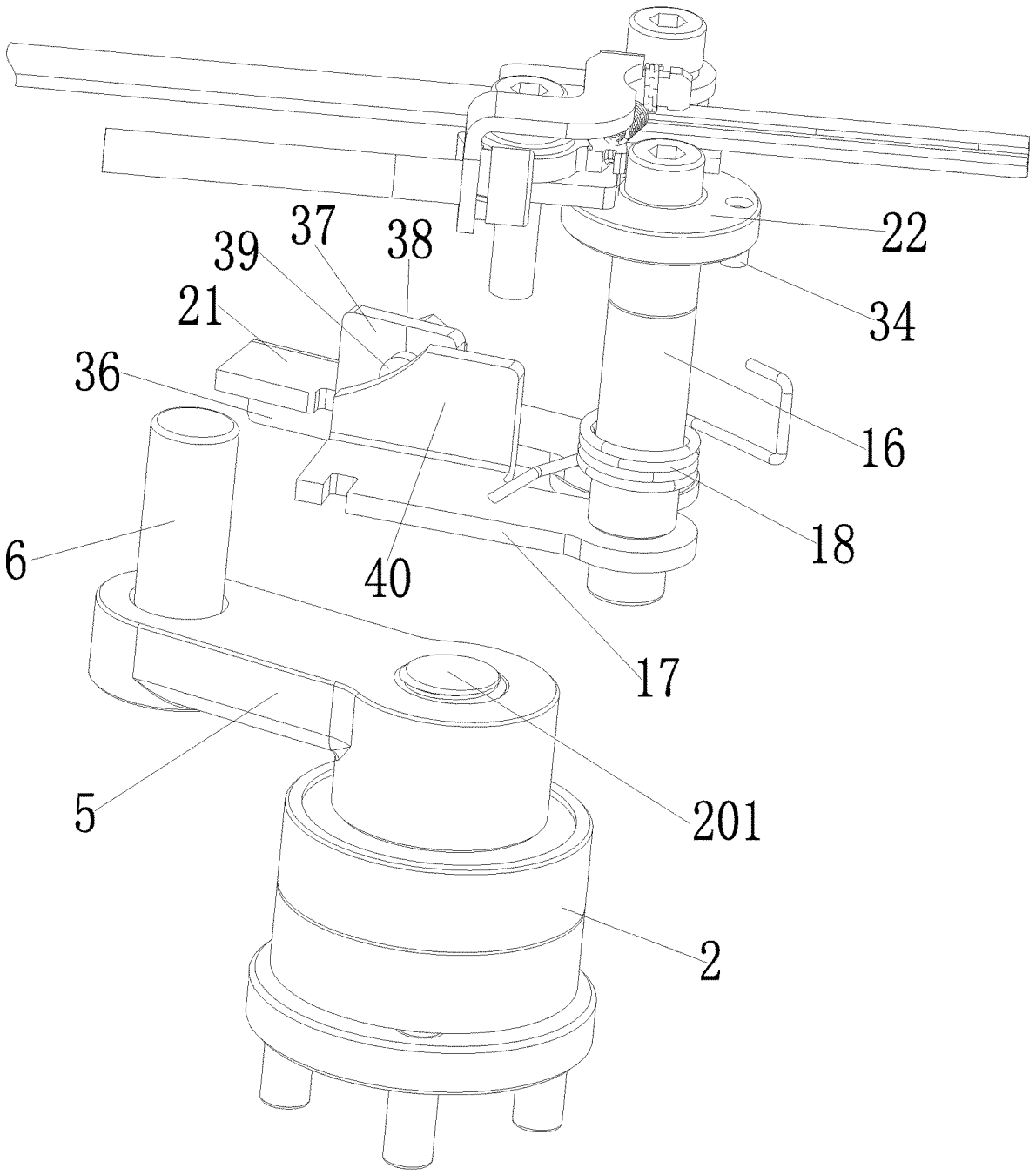
FIG. 4 is a structural view of the nailing force adjusting device from another viewing angle.
Figure 5:
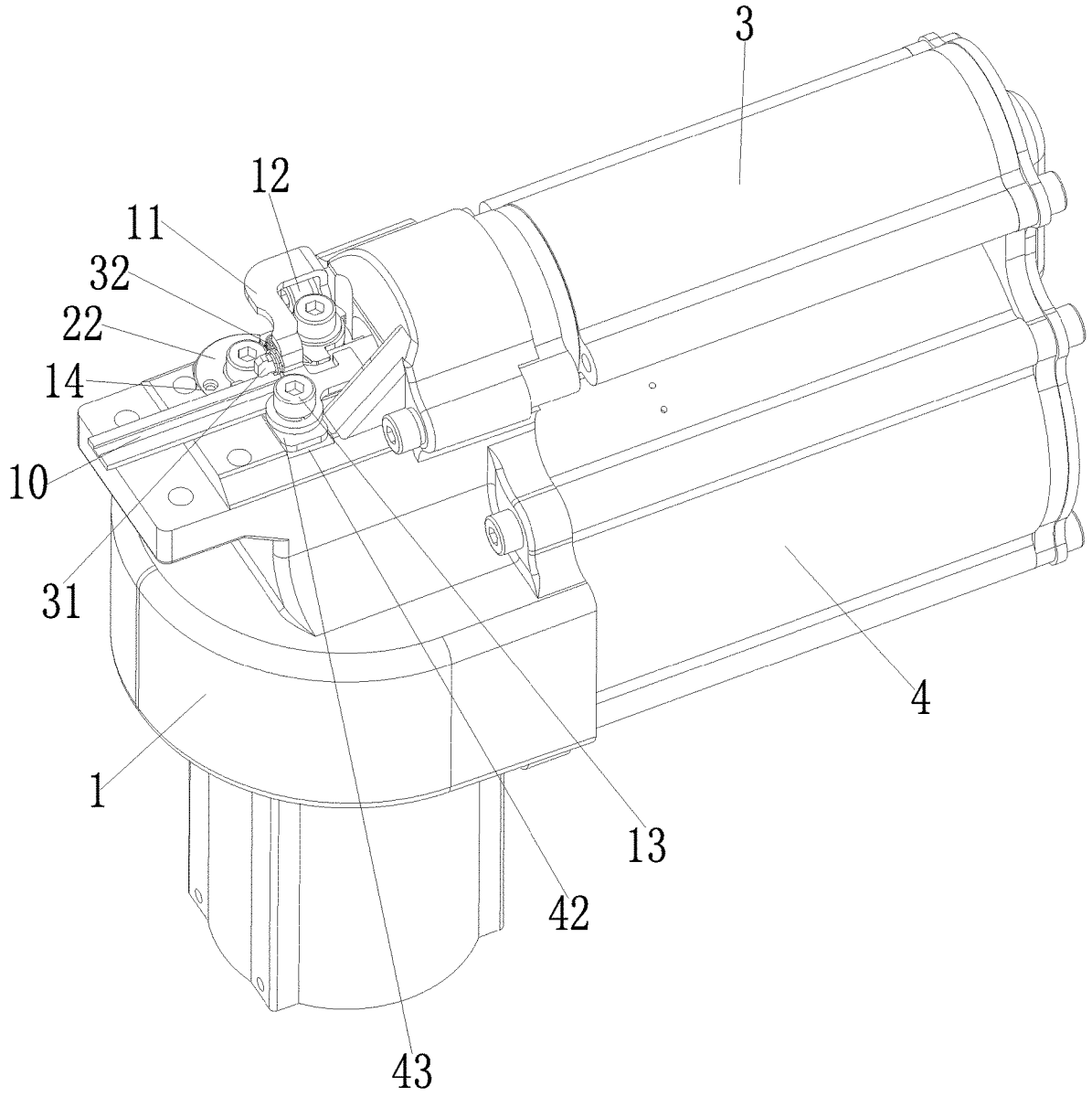
FIG. 5 is a perspective view of the present invention.
Figure 6:
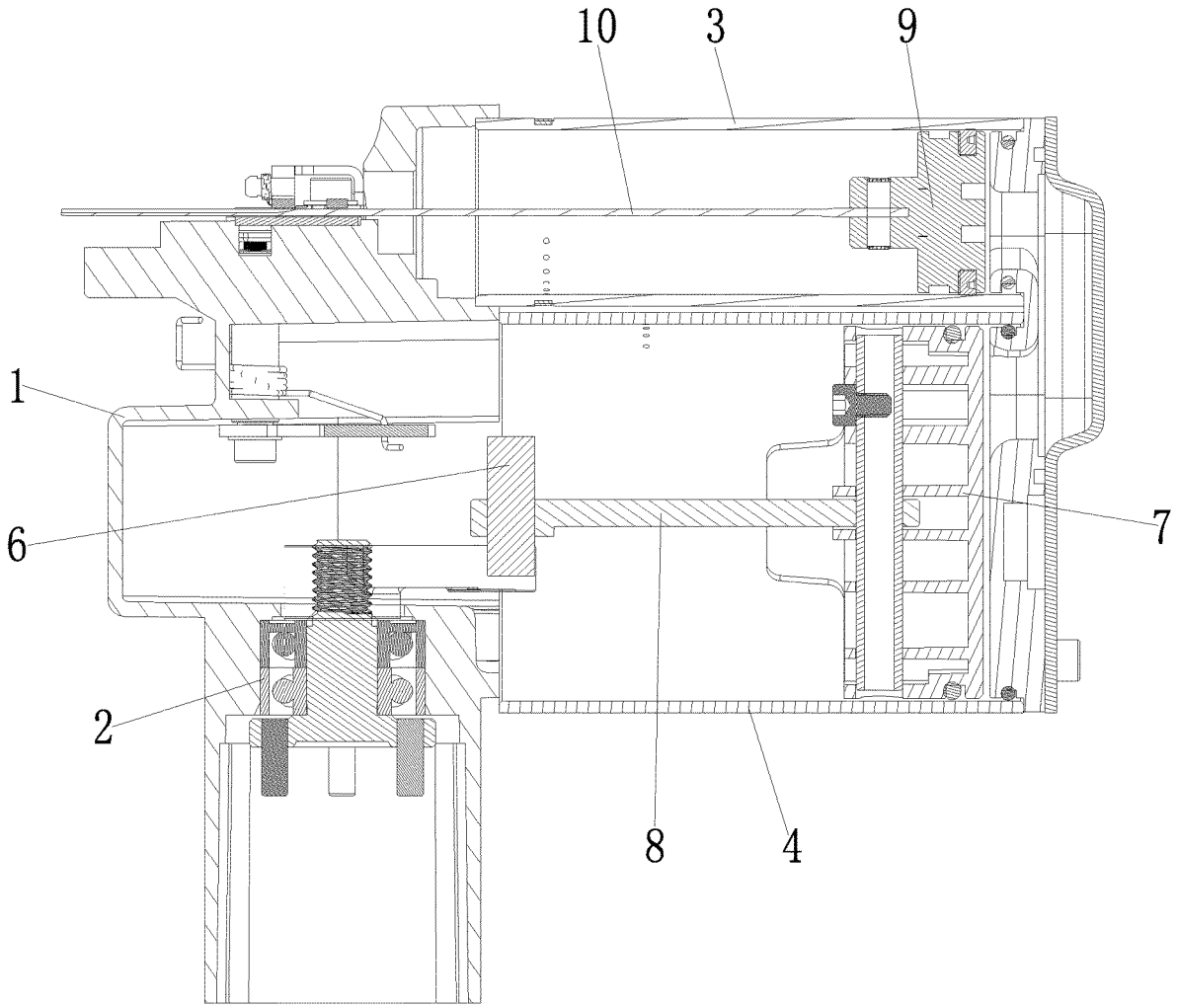
FIG. 6 is a sectional view of the present invention.
Figure 7:
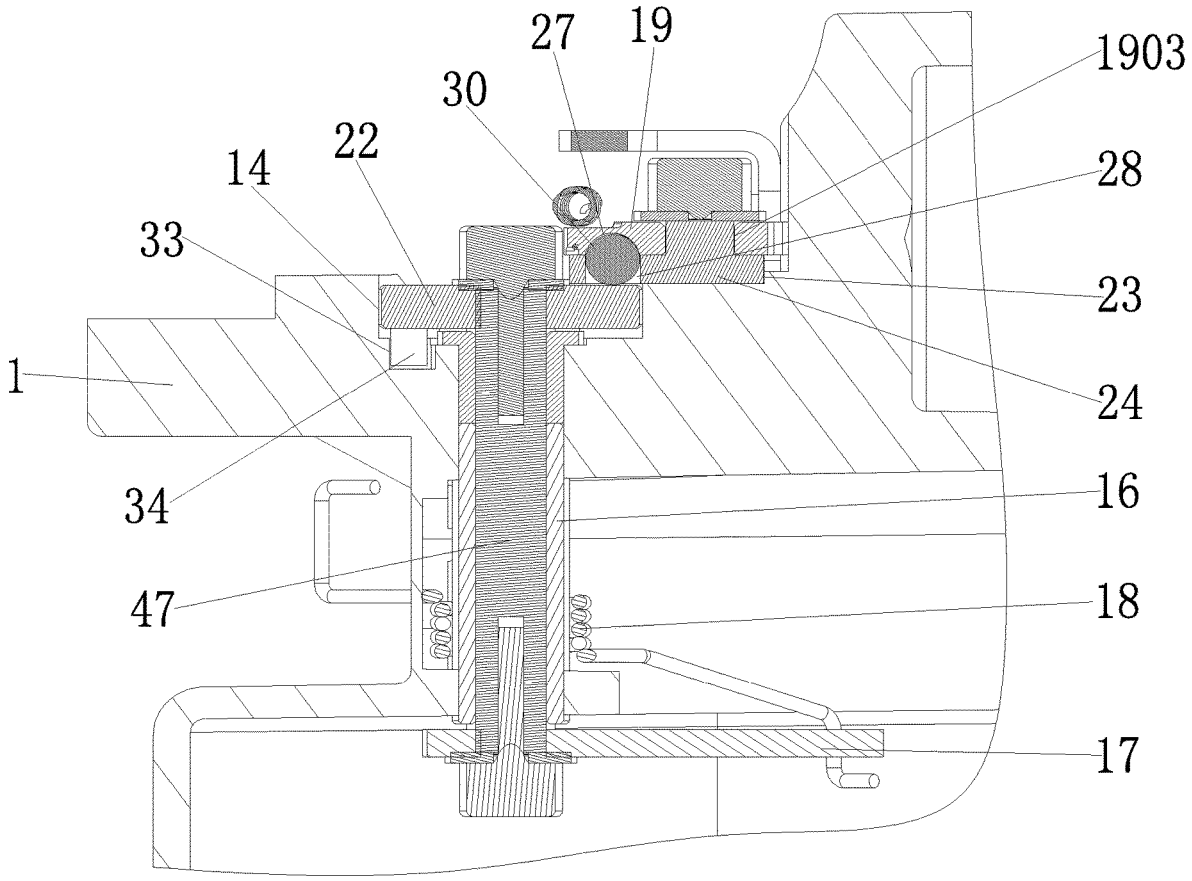
FIG. 7 is a sectional view of part of the present invention from one viewing angle.
Figure 8:
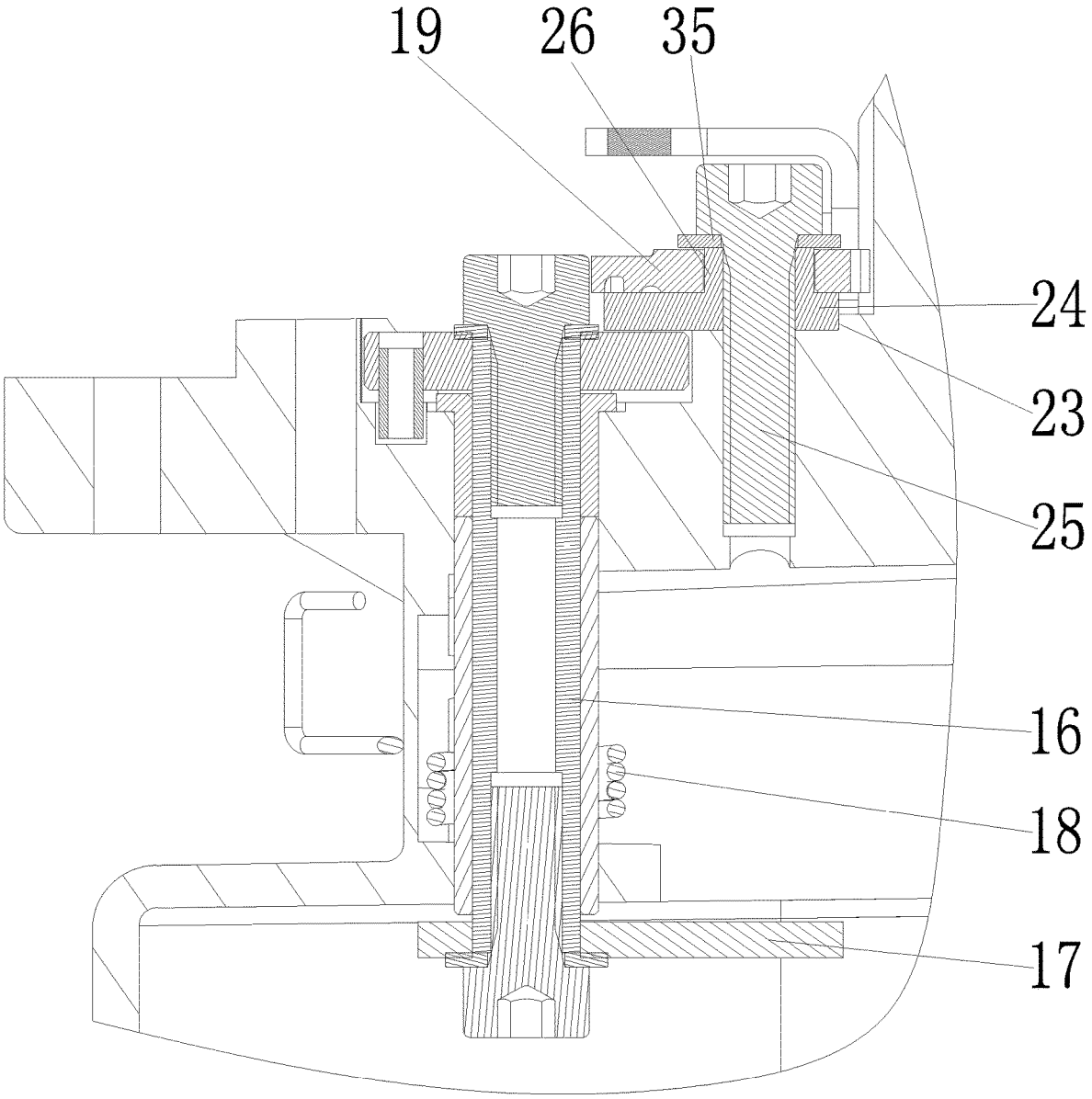
FIG. 8 is a sectional view of part of the present invention from another viewing angle.
Figure 9:
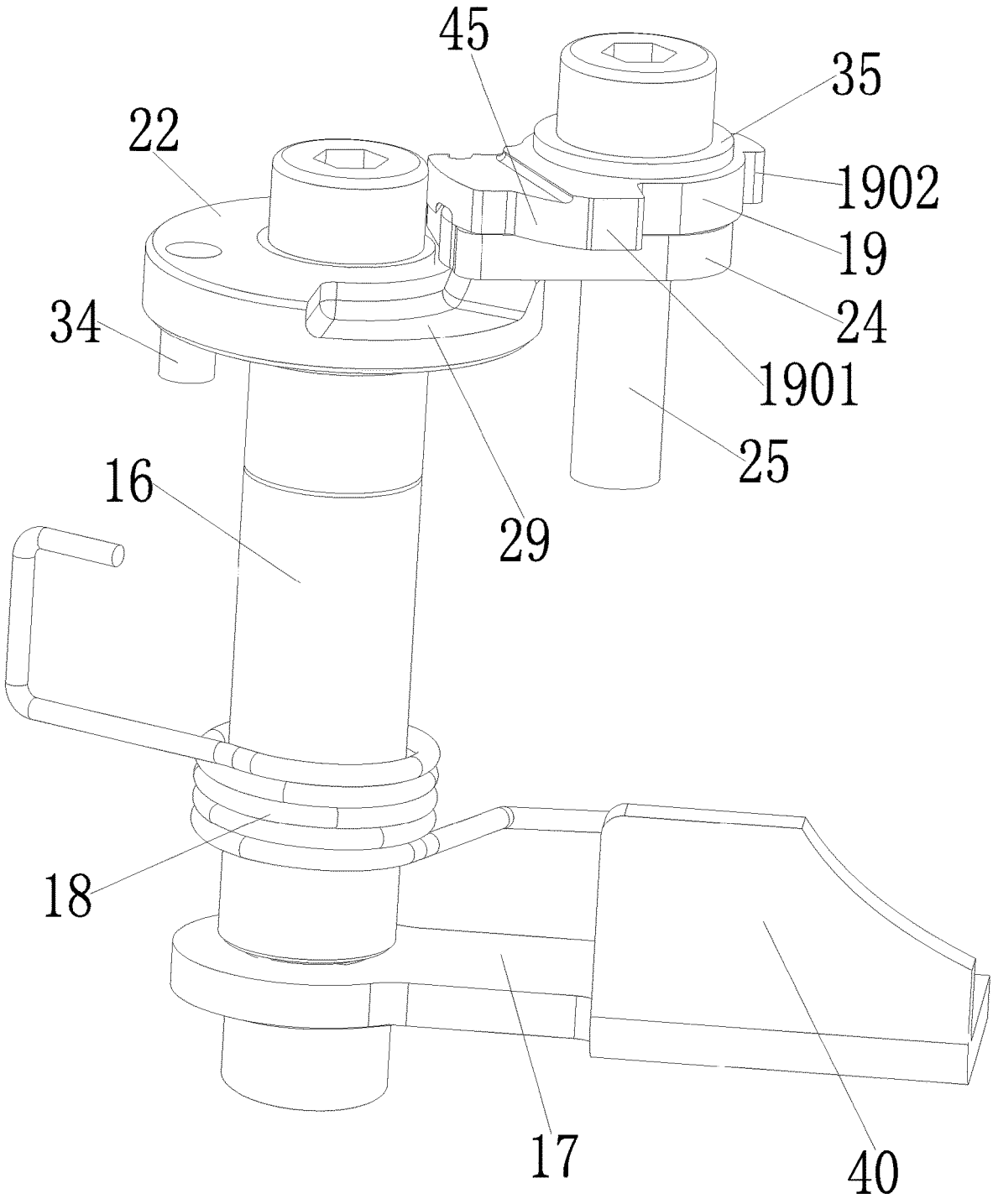
FIG. 9 is a structural view of the automatic unlocking device.

Referring to FIG. 1 to FIG. 9, the present invention provides a locking device for adjusting nailing force of an electric nail gun, which comprises a power box 1, a driving motor configured inside the power box 1, and an upper cylinder 3 and a lower cylinder 4 provided on the right side of the power box 1. The lower cylinder 4 is located right beneath the upper cylinder 3. The driving motor is connected with a connecting arm 5 through a reducing mechanism 2. The end of the connecting arm 5 is provided with an eccentric spindle 6. A lower piston 7 is provided inside the lower cylinder 4. The lower piston 7 is hinged with a piston arm 8 on its top side. The piston arm 8 is connected to the eccentric spindle 6. An upper piston 9 is provided inside the upper cylinder 3. A firing pin 10 is provided at the center of the sidewall on the left side of the upper piston 9. The left end of the firing pin 10 sticks out of the upper cylinder 3. A fixing part 11 is provided on the left side of the upper cylinder 3 and above the power box 1. One end of the fixing part 11 is fixed on the upper cylinder 3 through a first screw 12, whereas the other end of the fixing part 11 is fixed on the power box 1 through a second screw 13. A rotating groove 14 is provided on the back side of the upper surface of the power box 1. The bottom of the rotating groove 14 is provided with a rotating hole 15, which is communicated to the inside space of the power box 1. A matching rotating bushing 16 is provided inside the rotating hole 15. A matching rotating shaft 47 is provided with inside the rotating bushing 16. The lower end of the rotating shaft 47 penetrates downward into the power box 1 and is provided with a short rocker 17. A torsion spring 18 is sleeved outside the rotating bushing 16. One end of the torsion spring 18 is fixed on the short rocker 17, whereas the other end of the torsion spring 18 is fixed on the inner wall of the power box 1. The upper end of the rotating shaft 47 is provided with an automatic unlocking device matching the rotating groove 14. A matching locking block 19 is provided on the right side of the automatic unlocking device. A bayonet opening 20 is provided on the sidewall of the firing pin 10 on the side facing the locking block 19. The locking block 19 is provided with a locking part 1901 matching the bayonet opening 20. The lower end of the second screw 13 penetrates into the inside space of the power box 1 and is hinged with a long rocker 21. The long rocker 21 is provided with a nailing force adjusting device matching the short rocker 17.

The automatic unlocking device comprises is provided on the driving wheel 22 on the top end of the rotating shaft 47. The driving wheel 22 is located inside the rotating groove 14. The upper surface of the power box 1 is provided with a positioning slot 23 that is communicated to the rotating groove 14. The positioning slot 23 is located on the right side of the rotating groove 14. A matching locking seat 24 is provided inside the positioning slot 23. The locking seat 24 is fixed inside the positioning slot 23 through a third screw 25. The upper surface of the locking seat 24 is provided with a rotating lug boss 26. The locking block 19 is sleeved outside the rotating lug boss 26 through a movable hole 1903 configured in its center. The lower surface of the locking block 19 is provided with a ball groove 27 on the left side. The left, part of the locking seat 24 is provided with a lifting hole 28 that is communicated to the ball groove 27. The edge on the front side of the driving wheel 22 is provided with an arc-shaped unlocking slot 29. The slot sidewall of the unlocking slot 29 adjacent to the lifting hole 28 is tilted toward the lifting hole 28. The left side of the locking seat 24 is located above the driving wheel 22 and limits the driving wheel 22 to move upward. A locking steel ball 30 is provided inside the lifting hole 28. The lower end of the locking steel ball 30 touches the upper surface of the driving wheel 22. The upper end of the locking steel ball 30 is fitted into the ball groove 27. The sidewall of the fixing part 11 on the left side is provided with a fixing arm 31. The fixing arm 31 is connected to the left part of the locking block 19 through a draw spring 32.

The bottom of the rotating groove 14 is provided with a limiting slot 33, located on one side of the top orifice of the rotating hole 15. The limiting slot 33 is in an arc shape. The lower surface of the driving wheel 22 is provided with a limiting column 34 that matches the limiting slot 33.

A limiting gasket 35 is provided between the rotating lug boss 26 and the head of the third screw 25. The outer diameter of the limiting gasket 35 is larger than the inner diameter of the locking block 19.

The nailing force adjusting device comprises a push plate 36 configured on the tip of the long rocker 21. The position of the push plate 36 corresponds to the position of the eccentric spindle 6. The push plate 36 is located on the side of the long rocker 21 away from the short rocker. The sidewall of the long rocker 21 on the side facing the short rocker 17 is provided with an adjusting plate 37. The adjusting plate 37 is provided with an adjustment screw hole 38. The adjustment screw hole 38 is in threaded connection with an adjusting bolt 39. The sidewall of the short rocker 17 on the side facing the long rocker 21 is provided with an unlocking plate 40, with its position corresponding to the position of the adjusting plate 37. One end of the adjusting bolt 39 sticks out of the adjustment screw hole 38, and is pressed upon the unlocking plate 40.

The end of the adjusting bolt 39 pressing upon the unlocking plate 40 is hemispherical.

The end of the adjusting bolt 39 not pressing upon the unlocking plate 40 sticks out of the adjustment screw hole 38 and is in threaded connection with a fastening nut 41, which is pressed against the adjusting plate 37.

The upper surface of the power box 1 is provided with a catching slot 42 with its position corresponding to the position of the second screw 13. A matching guiding plate 43 is provided inside the catching slot 42. The firing pin 10 is located above the guiding plate 43 and is pressed against the upper surface of the guiding plate 43. The rear end of the guiding plate 43 protrudes backward out of the catching slot 42 and covers the unlocking slot 29 from above.

The inner wall of the bayonet opening 20 on the left side is provided with an arc-shaped guiding surface 44. The left side of the locking part 1901 is provided with a slide-out surface 45 matching the guiding surface 44.

The front side of the end of the fixing part 11 fixed by the first screw 12 is provided with a stopping block 46. The sidewall of the locking block 19 on the right side is provided with a limiting position 1902 matching the stopping block 46.

Below is a description of the operation of the present invention:

To use the electric nail gun for nailing, firstly start the driving motor. When the driving motor is running, the driving motor will drive the connecting arm 5 to rotate through the reducing mechanism 2, which in turn drives the eccentric spindle 6 to rotate. When the eccentric spindle 6 turns around the output shaft 201 of the reducing mechanism 2, the eccentric spindle 6 will finally go to the front side of the push plate 36 on the end portion of the long rocker 21, and knock on the push plate 36, pushing the push plate 36 backward. As the long rocker 21 is hinged on the lower end of the second screw 13, when the push plate 36 is pushed backward, the long rocker 21 will rotate backward around the second screw 13. As the adjusting bolt 39 screwed on the adjusting plate 37 of the long rocker 21 is pressed on the unlocking plate 40 of the short rocker 17, when the long rocker 21 rotates backward, the short rocker 17 will rotate backward under the push of the adjusting bolt 39. As the short rocker 17 is fixed on the lower end of the rotating shaft 47, the rotating shaft 47 will rotate along with the short rocker 17. At this time, the torsion spring 18 sleeved outside the rotating bushing 16 will deform under the drive of the rotating short rocker 17 and generate an elastic force.

The rotating shaft 47 rotates anticlockwise under the drive of the rotating short rocker 17. As the driving wheel is configured on the upper end of the rotating shaft 47, the driving wheel 22 will rotate anticlockwise along with the rotating shaft 47. At this time, the unlocking slot 29 on the edge of the front side of the driving wheel 22 will gradually approach the lifting hole. Firstly, the slot sidewall of the unlocking slot 29 adjacent to the lifting hole 28 will move to the position beneath the lifting hole 28, the slot sidewall of the unlocking slot 29 will tilt toward the lifting hole 28, and the locking steel ball 30 originally inside the lifting hole 28 will slip along the slot side wall of the unlocking slot 29 adjacent to the lifting hole 28 into the unlocking slot 29. As the unlocking slot 29 is enclosed by the inner wall of the rotating groove 14, it can effectively limit the locking steel ball 30 inside the unlocking slot 29, allowing it to move only inside the unlocking slot 29. When the locking steel ball 30 moves inside the unlocking slot 29, the upper part of the locking steel ball 30 is always located inside the lifting hole 28. When the locking steel ball 30 moves from the lifting hole 28 into the unlocking slot 29, the upper end of the locking steel ball 30 is no longer embedded inside the ball groove 27 on the lower surface of the locking block 19. The locking steel ball 30 can no longer limit the rotation of the locking block 19.

When the eccentric spindle 6 rotates, the eccentric spindle 6 will drive the lower piston 7 to move through the piston arm 8, and to squeeze the gas inside the lower cylinder 4 into the upper cylinder 3. As a result, the pressure of the upper cylinder 3 is greatly increased to push the upper piston 9 to move leftward. At this time, the upper piston 9 will drive the firing pin 10 to move leftward, and shoot the nail inside the nailing channel of the electric nail gun out from the nozzle of the electric nail gun. Thus, the nailing operation is completed. When the locking block 19 is no longer limited by the locking steel ball, along with the leftward movement of the firing pin 10, the firing pin 10 will apply the leftward moving force upon the locking part of the locking block 19 through the bayonet opening 20. As the locking part 1901 is pushed leftward, the locking block 19 will turn clockwise around the rotating lug boss 26. The locking part 1901 of the locking block 19 will move away from the bayonet opening 20. The locking block 19 can no longer limit the movement of the firing pin 10 through the locking part 1901. As the fixing arm 31 of the fixing part 11 is fixed and will not move, when the locking block 19 turns clockwise, the draw spring 32 is pulled and will generate an elastic force. When the firing pin 10 completes nailing is reset, the draw spring 32 will reset the locking block 19 through its own elastic force, so that the locking part 1901 of the locking block. 19 is caught again inside the bayonet opening 20. The draw spring 32 only functions to reset the locking block 19, it cannot press the locking part 1901 of the locking block 19 tightly upon the bayonet opening 20 through its own elastic force. This can avoid the problem of surface wearing caused by the tight pressure of the locking part 1901 of the locking block 19 upon the bayonet opening 20 through its own elastic force.

When the locking block 19 is reset, the short rocker 17 will be reset simultaneously under the elastic force of the torsion spring 18, and will drive the rotating shaft 47 to return to the original position. When the rotating shaft 47 returns to the original position, the driving wheel 22 will immediately be restored. At this time, the driving wheel 22 will rotate clockwise, the unlocking slot 29 of the driving wheel 22 will gradually move forward. The locking steel ball 30 will then move inside the lifting hole 28, and finally move to the original slot sidewall of the unlocking slot 29 adjacent to the lifting hole. As the slot sidewall is tilted toward the lifting hole 28, the locking steel ball 30 will move along the tilted slot sidewall through the lifting hole 28 and toward the locking block 19. The locking steel ball 30 moves to the lower surface of the locking block 19 till they are in contact. Now the driving wheel 22 stops resetting, and the locking part 1901 on the locking block 19 touches the side surface 19 of the firing pin 10. When the bayonet opening 20 is reset and withdraws to the locking part 1901, the locking part 1901 of the locking block 19 continues to move anticlockwise under the elastic force of the draw spring 32, and move perfectly into the bayonet opening 20. And the upper part of the locking steel ball 30 originally positioned inside the lifting hole 28 will again be embedded into the ball groove 27 on the lower surface of the locking block 19. Now the driving wheel 22 is completely reset. The upper surface of the driving wheel 22 is pressed against the steel ball 30. The locking block 19 is in the locked state, stopping the rotation of the locking block 19. At this time, the firing pin 10 is still withdrawing. The guiding, surface 44 on the firing pin 10 contacts the slide-out surface 45 of the locking block 19, and the withdrawing of the firing pin 10 is completely stopped, realizing the limitation of the firing pin 10 by the locking block 19. The withdrawing of the firing pin 10 is stopped. Thus, the firing pin 10 will not move continuously backward to collide with the body of the upper cylinder 3 to cause damage to the upper cylinder 3. When the driving wheel 22 returns to its original position, the upper surface of the driving wheel 22 will firmly press the locking steel ball 30 inside the ball groove 27, effectively ensuring the stability of the firing pin 10 locked by the locking part 1901 of the locking block 19.

To adjust the nailing force, the user can turn the adjusting bolt 39, so that the adjusting bolt 39 can move forward or backward along the thread path of the adjustment screw hole 38, and the distance between the adjusting plate 37 on the long rocker 21 and the unlocking plate 40 on the short rocker 17. Thus, the position of the push plate 36 on the long rocker 21 can be changed. The larger the distance between the adjusting plate 37 and the unlocking plate 40, the push plate 36 on the tip of the long rocker 21 will be further frontward, and the earlier the eccentric spindle 6 will push the push plate 36 during rotation, and the locking block 19 will release the locking of the firing pin 10 in advance, the earlier the locking block 19 is unlocked, the smaller the resistance from the locking part 1901 of the locking block 19 will be generated against the firing pin 10. The later the locking block 19 is unlocked, the larger the resistance from the locking part 1901 of the locking block 19 will be generated against firing pin 10, and the larger the force of the firing pin 10 will be, and the stronger the collision by the firing pin 10 against the nail. In this way, the nailing force is adjusted.

From the above, it is known that the present invention uses the locking steel ball 30 of an automatic unlocking device to limit the position of the locking block 19, instead of using elastic force to press the locking part 1901 of the locking block 19 tightly inside the bayonet opening 20 of the firing pin 10. This can avoid surface wearing caused by external force when the locking part 1901 of the locking block 19 touches the bayonet opening 20, and can effectively ensure the accuracy of position of the firing pin 10 when locked by the locking part 1901 of the locking block 19, thus ensuring the nailing quality. When the firing pin 10 moves, the locking part 1901 of the locking block 19 will be driven by the firing pin 10 to automatically move out of the bayonet opening 20, thus realizing automatic locking. The nailing force adjusting device can effectively adjust the force of collision of the firing pin 10, thus realizing the adjustment of the nailing force so that the electric nail gun can meet different nailing requirements without the need to replace the whole driving motor. Therefore, the present invention can effectively save usage costs.

The bottom of the rotating groove 14 is provided with a limiting slot 33 located on one side of the upper aperture of the rotating hole 15. The limiting slot 33 is arc-shaped. The lower surface of the driving wheel 22 is provided with a limiting column 34 matching the limiting slot 33. The existence of the limiting column 34 can guarantee accurate resetting of the driving wheel 22 along the path of the limiting slot 33.

A limiting gasket 35 is provided between the rotating lug boss 26 and the third screw 25. The outer diameter of the limiting gasket 35 is larger than the inner diameter of the locking block 19. Such an assembly method can guarantee the stability when the locking block 19 rotates around the rotating lug boss 26.

The end of the adjusting bolt 39 not pressed on the unlocking plate 40 sticks out of the adjustment screw hole 38 and is in threaded connection with a fastening nut 41 pressed against the adjusting plate 37. The existence of the fastening nut 41 can effectively improve the stability of the adjusting bolt 39.

The upper surface of the power box 1 is provided with a catching slot 42 with its position corresponding to the second screw 13. A matching guiding plate 43 is provided inside the catching slot 42. The firing pin 10 is located above the guiding plate 43 and is pressed against the upper surface of the guiding plate 43. The rear part of the guiding plate 43 sticks backward out of the catching slot 42 and covers the unlocking slot 29 from above. The existence of the guiding plate 43 can guide the firing pin 10 to improve the stability of the firing pin 10 when it is moved.

The inner wall of the bayonet opening 20 on the left side is provided with an arc-shaped guiding surface 44. The left side of the locking part 1901 is provided with a slide-out surface 45 matching the guiding surface 44. Through coordination between the guiding surface 44 and the slide-out surface 45, when the firing pin 10 pushes the locking part, the locking block 19 can leave the bayonet opening 20 more smoothly.

The front side of the end of the fixing part 11 fixed by the first screw 12 is provided with a stopping block 46. The sidewall of the locking block 19 on the right side is provided with a limiting position 1902 pressed against the stopping block 46. The stopping block 46 can limit the position of the locking block 19 through the limiting position 1902, so as to avoid excessive recovery of the locking block 19 and collision against the inner wall of the bayonet opening 20.

We claim:

1. A locking device for adjusting nailing force of an electric nail gun, comprising a power box, a driving motor configured inside the power box, and an upper cylinder and a lower cylinder provided on a side of the power box, wherein the lower cylinder is located beneath the upper cylinder, the driving motor is connected with a connecting arm through a reducing mechanism, an end of the connecting arm is provided with an eccentric spindle, a lower piston is provided inside the lower cylinder, a top side of the lower piston is hinged with a piston arm, the piston arm is connected to the eccentric spindle, an upper piston is provided inside the upper cylinder, a firing pin is provided in a center of a side of the upper piston, an end of the firing pin sticks out of the upper cylinder, a fixing part is provided on a side of the upper cylinder and above the power box, one end of the fixing part is fixed on the upper cylinder through a first screw and a second screw; a rear side of an upper surface of the power box is provided with a rotating groove; a bottom of the rotating groove is provided with a rotating hole communicated to an inside space of the power box; a matching rotating bushing is provided inside the rotating hole, and a matching rotating shaft is provided inside the matching rotating bushing; a lower end of the matching rotating shaft sticks downward into the power box and is provided with a second rocker; a torsion spring is sleeved outside the rotating bushing; one end of the torsion spring is fixed on the second rocker, the other end of the torsion spring is fixed on an inner wall of the power box; an upper end of the rotating shaft is provided with an automatic unlocking device joining the rotating groove; a matching locking block is provided on a right side of the automatic unlocking device; a side of the firing pin opposite to the matching locking block is provided with a bayonet opening; a locking part matching the bayonet opening is provided on the matching locking block; the lower end of the second screw sticks into an internal area of the power box and is hinged with a first rocker; the first rocker is provided with a nailing force adjusting device joining the second rocker.

2. The locking device for adjusting nailing force of the electric nail gun defined in claim 1, wherein the automatic unlocking device includes a driving wheel configured on the matching rotating shaft, said driving wheel is located inside the rotating groove; the upper surface of the power box is provided with a positioning slot communicated to the rotating groove, the positioning slot is located on a side of the rotating groove; a matching locking seat is provided inside the positioning slot, the matching locking seat is fixed to the inside the positioning slot through a third screw; an upper surface of the locking seat is provided with a rotating lug boss; the matching locking block is sleeved outside the rotating lug boss through a movable hole configured in a center of the matching locking block; a ball groove is provided on a side of a surface of the matching locking block; a side of the matching locking seat is provided with a lifting hole communicated to the ball groove; an edge of the driving wheel is provided with an arc-shaped unlocking slot, a side of the arc-shaped unlocking slot adjacent to the lifting hole is inclined towards the lifting hole; a side of the locking seat is located above the driving wheel and limits the movement of the driving wheel; a locking steel ball is provided inside the lifting hole, a lower end of the locking steel ball is pressed against a surface of the driving wheel, the upper end of the locking steel ball is embedded into the ball groove; a side of the fixing part is provided with a fixing arm; the fixing arm and a part of the locking block are connected to each other through a draw spring.

3. The locking device for adjusting nailing force of the electric nail gun defined in claim 2, wherein the bottom of the rotating groove is provided with a limiting slot, located on one side of the top orifice of the rotating hole, the limiting slot is in an arc shape, a surface of the driving wheel is provided with a limiting column matching the limiting slot.

4. The locking device for adjusting nailing force of the electric nail gun defined in claim 2, wherein a limiting gasket is provided between the rotating lug boss and the head of the third screw, and the outer diameter of the limiting gasket is larger than a diameter of the locking block.

5. The locking device for adjusting nailing force of the electric nail gun defined in claim 1, wherein the nailing force adjusting device comprises a push plate configured on a tip of the first rocker, the position of the push plate corresponds to the position of the eccentric spindle, the push plate is located on a side of the first rocker away from the second rocker, the side of the first rocker facing the second rocker is provided with an adjusting plate, the adjusting plate is provided with an adjustment screw hole, the adjustment screw hole is in threaded connection with an adjusting bolt, a side of the second rocker facing the first rocker is provided with an unlocking plate, with its position corresponding to the position of the adjusting plate, one end of the adjusting bolt sticks out of the adjustment screw hole, and is pressed upon the unlocking plate.

6. The locking device for adjusting nailing force of the electric nail gun defined in claim 5, wherein the one end of the adjusting bolt pressed upon the unlocking plate is hemispherical.

7. The locking device for adjusting nailing force of the electric nail gun defined in claim 5, wherein an other end of the adjusting bolt not pressed upon the unlocking plate sticks out of the adjustment screw hole and is in threaded connection with a fastening nut pressed against the adjusting plate.

8. The locking device for adjusting nailing force of the electric nail gun defined in claim 1, wherein the upper surface of the power box is provided with a catching slot, with its position corresponding to the second screw; a matching guiding plate is provided inside the catching slot, the firing pin is located above the guiding plate and is pressed against an upper surface of the guiding plate; the rear part of the guiding plate protrudes backward out of the catching slot and covers the arc-shaped unlocking slot from above.

9. The locking device for adjusting nailing force of the electric nail gun defined in claim 1, an inner wall on a side of the bayonet opening is provided with an arc-shaped guiding surface; a side of the locking part is provided with a slide-out surface matching the guiding surface.

10. The locking device for adjusting nailing force of the electric nail gun defined in claim 1, wherein the front side of the one end of the fixing part fixed by the first screw is provided with a stopping block; a surface of the locking block is provided with a limiting position pressed against the stopping block.

* * * * *